US005203963A

United States Patent [19]

Henricson

[11] Patent Number: 5,203,963

[45] Date of Patent: Apr. 20, 1993

[54] CONTINUOUS TREATMENT OF SMALL CHIPS

[75] Inventor: Kaj Henricson, Kotka, Finland

[73] Assignee: A. Ahlstrom Corporation, Karhula, Finland

[21] Appl. No.: 779,809

[22] Filed: Oct. 21, 1991

[51] Int. Cl.[5] ..... D21C 3/26

[52] U.S. Cl. ..... 162/19; 162/60

[58] Field of Search ..... 162/16, 19, 17, 60, 162/82, 83, 84

[56] References Cited

U.S. PATENT DOCUMENTS 4,971,658 11/1990 Henricson et al. ..... 162/60

5,053,108 10/1991 Richter ..... 162/237

OTHER PUBLICATIONS

John F. Oettinger, Paper Trade Journal, Jun. 10, 1974, pp. 30–33.

T. Earl Winstead, Paper Trade Journal, Oct. 16, 1972, pp. 52–53.

Kamyr, "Continuous Cooking and Washing Systems" brochure, Jul., 1988.

*Primary Examiner*—W. Gary Jones

*Assistant Examiner*—Dean Nguyen

*Attorney, Agent, or Firm*—Nixon & Vanderhye

[57] ABSTRACT

Paper pulp is produced from small chips (e.g. having a smallest dimension of between about 1 and 5 mm), which may be more easily penetrated by the treatment liquids resulting in a more uniform Kappa distribution which makes it possible to cook to lower Kappa numbers without losing strength. The chips are steamed and then impregnated with sulfur containing liquor in an impregnation vessel having a conveyor. The conveyor, such as an endless belt with baffles, moves the chips through the liquor rather than trying to circulate the liquor. From the impregnation vessel the chips move to the top of an upright digester where they are steamed, and then are subjected to digesting conditions, entrained in white liquor, in the digester and discharged from the bottom. The digester has smooth side walls, devoid of screens and circulation loops. At the bottom of the digester the chips—at a consistency of about 10 to 20%—are diluted to a consistency of about 6 to 10% and then passed, with a feeding a mechanism, to a first pressure diffuser. From the first pressure diffuser the chips pass through a flow control valve to a hot alkali extraction tank, and then to a second pressure diffuser.

16 Claims, 1 Drawing Sheet

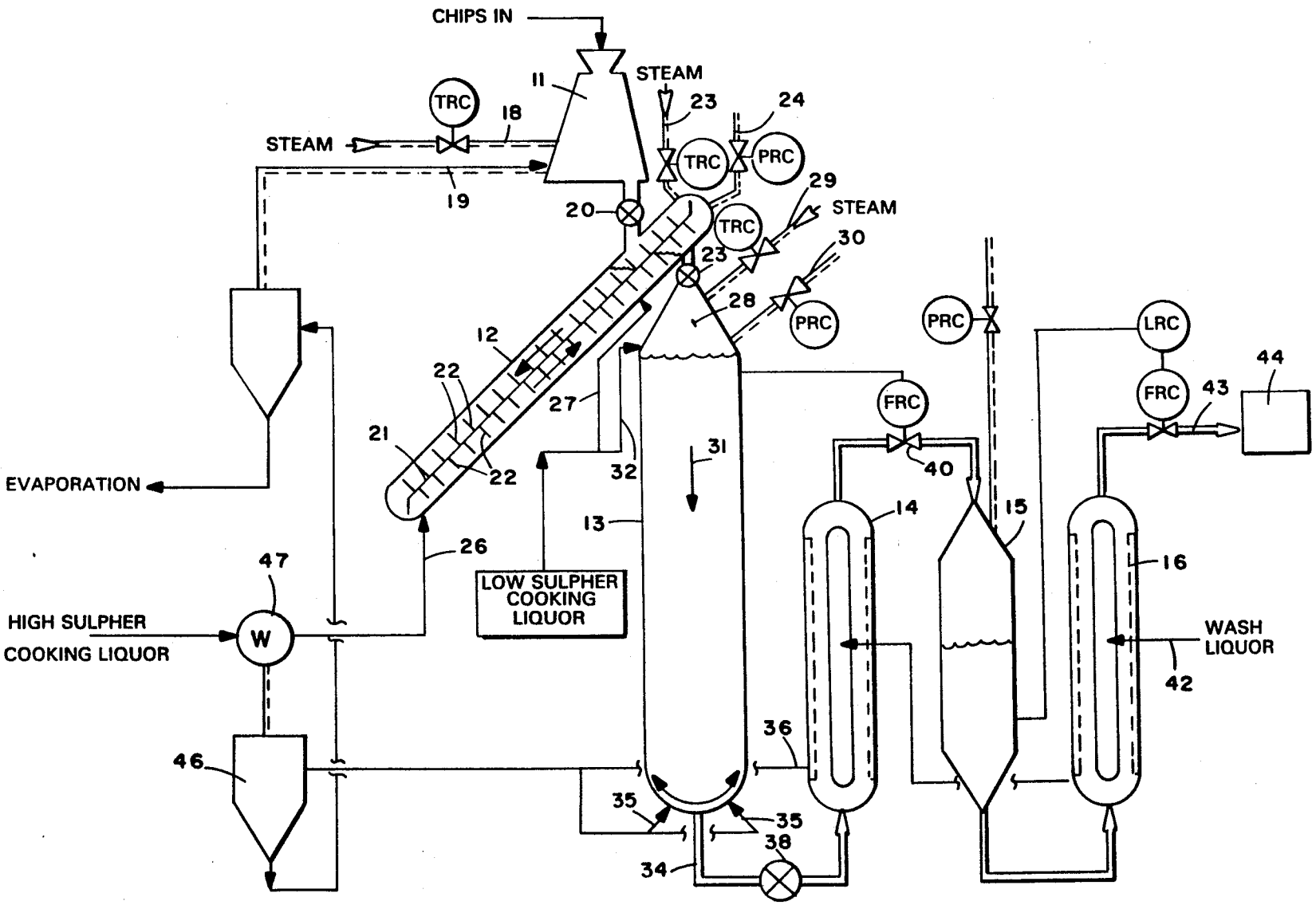
CHIPS IN
STEAM
STEAM
STEAM
TRC
TRC
TRC
TRC
PRC
PRC
PRC
PRC
FRC
FRC
LRC
W
WASH LIQUOR
LOW SULPHER COOKING LIQUOR
HIGH SULPHER COOKING LIQUOR
EVAPORATION
11
12
13
14
15
16
18
19
20
21
22
23
24
26
27
28
29
30
31
32
34
35
36
38
40
42
43
44
46
47

CONTINUOUS TREATMENT OF SMALL CHIPS

BACKGROUND AND SUMMARY OF THE INVENTION

There are many circumstances wherein it is desirable to utilize small chips of cellulosic fibrous material (typically wood) in the production of paper pulp. However heretofore it has been difficult to handle small chips utilizing conventional equipment. Small chips require different equipment and processing than regular size chips, or sawdust. A small chip may be defined as one having a smallest dimension of about 1-5 mm, typically roughly about 2 mm. The length of the chips is not critical, rather it is their minimum dimension (thickness) that is important.

According to the present invention it is possible to properly treat small chips to produce paper pulp. Small chips allow a better penetration with the treatment chemicals, resulting in a more uniform cooking process. Small chips also provide a more uniform Kappa distribution which makes it possible to cook to lower Kappa numbers without losing strength. Further, small chips can be made up of poorer raw material than conventional large chips, including waste from saw mills, processing facilities, and the like that is not in the pulverized form of sawdust.

One of the keys to being able to handle the small chips according to the invention is the ability to treat the chips without liquor circulations. Liquor circulations, which are standard in conventional impregnation vessels and digesters, are not feasible when treating small chips. Therefore according to the present invention it is necessary to move the chips through the treatment liquid, rather than circulating the treatment liquid.

According to the invention, chips are first steamed in a conventional steaming vessel and then passed through a low pressure feeder into an impregnation vessel with an interior conveying means. Preferably the impregnation vessel is disposed at an angle of between about 30°-60° to the horizontal and includes an endless belt with paddles extending therefrom which moves within the vessel. Sulfur containing liquor is added to the impregnation vessel, and the conveyor moves the chips through the liquor to a second lower pressure feeder at the top of a vertical digester.

At the top of the digester, steam is supplied to the chips to heat them to cooking temperature (e.g. about 150°-180° C.). The chips move in the slurry of white liquor down through the digester to be discharged from the bottom. The digester has smooth interior walls, being devoid of screens and circulation loops.

At the bottom of the digester, the slurry has a consistency of about 10 to 20%, and typically it is diluted—as with black liquor—to a consistency of about 10% or less. The chips then pass through a feeder without significant pressure reduction to a pressure diffuser or like pressure washing vessel, where the chips are subjected to a first wash. The liquor withdrawn from the first pressure diffuser is the black liquor that many be used for diluting the chips at the bottom of the digester, and also a part may be fed to a flash tank and the heat recovered therefrom to heat cooking liquor being supplied to the impregnation vessel.

From the top of the first pressure diffuser the paper pulp passes through a flow control valve and then to the top of a hot alkali extraction tank, which also has no circulation loops. From the bottom of that tank it goes to a second pressure diffuser where it is subjected to a second wash, with the liquor withdrawn from the second pressure diffuser being the wash liquor for the first pressure diffuser. The pulp withdrawn from the top of the second pressure diffuser may then be subjected to oxygen delignification, bleaching, or other additional treatment steps.

By practicing the present invention it is possible, in an energy efficient manner, to effectively produce paper pulp from chips having a smallest dimension of about 1 to 5 mm (typically about 2 mm). While the invention is particularly desirable for the treatment of small chips, however, it is to be understood that various aspects of the method and apparatus according to the invention also can be applied to conventional chips.

BRIEF DESCRIPTION OF THE DRAWING

FIG. 1 is a schematic view of exemplary apparatus according to the invention for practicing exemplary methods according to the invention.

DETAILED DESCRIPTION OF THE DRAWING

Exemplary apparatus according to the invention is illustrated schematically in FIG. 1. The main components of the apparatus include the chips bin 11, impregnation vessel 12, the digester 13, and subsequent treatment vessels; for example first pressure diffuser 14, a hot alkali extraction tank 15, and a second pressure diffuser 16. The apparatus is particularly adapted for the treatment of small chips of cellulosic fibrous material (typically wood), that is chips have a minimum dimension of greater than the size of sawdust, and less then the size of conventional chips, that is between about 1 and 5 mm, typically roughly about 2 mm. However the apparatus can also be used for the treatment of other comminuted cellulosic fibrous material besides small chips.

Preferably the chips are steamed in the conventional chips bin 11, as with steam added through lines 18, 19. From the chips bin 11 the chips pass through a conventional first low pressure feeder 20 to the impregnation vessel 12. The pressure within the impregnation vessel 12 typically is higher than atmospheric but less than that in the digester 13, for example the pressure in the vessel 12 may be about 4 bar. Note that the impregnation vessel 12 preferably is disposed at an angle, typically between about 30° to 60° to horizontal.

The impregnation vessel 12 must provide for impregnation of the chips without circulating liquids, which is impractical for small chips. This is accomplished by providing a conveyor means within the vessel 12 for moving the chips with respect to the impregnation liquor. The conveyor means may take the form of a screw, or the like, but preferably—as illustrated in FIG. 1 —comprises an endless belt 21 having a plurality of upstanding paddles 22 thereon. The belt and paddles are driven so that the chips are moved downwardly to the bottom of the impregnation vessel 12, and then upwardly back to the second low pressure feeder 23 at which point the impregnated chips are discharged to the top of the digester 13. Sulfur containing liquor for impregnating the chips may be added at one or more points along the length of the impregnation vessel 12, and steam is also added to the impregnation vessel. Steam may be supplied by line 23, while pressure relief is provided by line 24. High sulfur cooking liquor is added at line 26, and in addition a lower sulfur content cooking liquor may be added at line 27, just before the low pressure feeder 23. Cooking selectivity is improved by adding high sulfur cooking liquor initially, and then a lower sulfur cooking liquor at later stages. The high sulfidity liquor may be black liquor with sulfur added to it, or other types of liquors, instead of white liquor.

At the top section 28 of the digester 13, a steam or vapor phase is maintained. At that section 28 the chips are heated to cooking temperature (e.g. about 150°-180° C.) preferably by adding live steam from source 29 directly to the chips pressure relief is provided at 30. The chips form a column within the digester 13 and move downwardly therein, as shown schematically by the arrow 31, toward the bottom of the digester 13. The low sulfur cooking liquor may be added to the digester 13 instead of, or in addition to, the line 27, as indicated by line 32. The digester 13 has smooth interior side walls; that is it is devoid of screens and circulation loops, which would be impractical in treating small chips.

Within the digester 13, the chips entrained in cooking liquor typically have a consistency of about 10 to 20% solids. At the bottom of the digester 13 they are discharged into discharge conduit 34. Preferably the consistency of the chips is diluted just below the conduit 34, as by introducing dilution liquor by dilution liquor introduction means 35. The reason that the consistency is diluted is to start to cool the chips to stop the cooking action, to reduce the consistency therefrom to less than about 10% (typically about 6 to 10%) so that they can be effectively treated in the pressure diffuser 14, and to make it easier to uniformly discharge the digested chips into the conduit 34. The diluting liquor is preferably black liquor from line 36, black liquor being withdrawn through the withdrawal screens associated with the pressure diffuser 14.

In the line 34 the chips are subjected to some pressure reduction, however the pressure reduction desirably is not significant since it is desirable to maintain heat economy and pulp strength, which could be lost if the pressure was significantly reduced. Preferably, rotary valve 38 is utilized in the discharge line 34 to slightly reduce the pressure and control the flow of the pulp. The rotary valve 38 must be capable of maintaining sufficient pressure on the pressure diffuser side 14 thereof to avoid boiling, since the pulp is still very hot at this stage, e.g. the pulp can be about 160° C. A displacement MC® pump working backwards could also be utilized instead of a rotary valve 38.

The pressure diffuser 14 preferably is a conventional Kamyr, Inc. pressure diffuser, although any washing vessel capable of operating at about 8 to 10 bar is suitable. The pulp moves upwardly in the pressure diffuser 14 and is subjected to wash liquor, which is discharged liquor from the second pressure diffuser 16, and ultimately passes through the flow control valve 40 before entering the hot alkali extraction tank 15. The valve 40 controls flow through the diffusers but the valve must not do significant mechanical damage to the fibers. Little pressure reduction takes place across the valve 40.

The hot alkali extraction tank also has smooth interior walls. The smooth interior walls of the vessels 13, 15 make the control of the diffusers 14, 16 more simpler than they otherwise would be because they can be run separately. The hot alkali extraction tank 15 has a number of functions. It allows lignin to be extracted from the fibers, as disclosed in U.S. Pat. No. 4,971,658, the disclosure of which is hereby incorporated by reference herein. Also, by allowing some pressure reduction between the vessels 14. 15, the forces acting upon the fibers are reduced, but the smooth walls of the tank 15 and the lack of mechanical elements within it means that the strength of the fibers will not be degraded under the hot alkali conditions that exist within the tank 15.

After the pulp is withdrawn from the bottom of the tank 15 it passes to the bottom of the second diffuser 16 where it is again washed. Fresh wash liquor is added at line 42 to the second diffuser 16. The washed pulp withdrawn from the top of the second pressure diffuser 16 in line 43 may then pass to subsequent treatment stages 44, such as oxygen delignification, bleaching, subsequent washing, or like stages.

For heat economy, it is also desirable to use the black liquor withdrawn in line 36 to preheat the high sulfur liquor added in line 26 to the impregnation vessel 12. This is preferably accomplished utilizing a flash tank 46 and a heat exchanger 47. The steam and other vapor from the top of the flash tank 46 heats the high sulfur liquor passing through the heat exchanger 47, so that it is preheated when introduced at 26 into the impregnation vessel 12.

Utilizing the apparatus described above, a method of producing paper pulp from chips of cellulosic fibrous material having a smallest dimension of between about 1 and 5 mm may be practiced. The method comprises the following steps, which are practiced continuously and sequentially:

(a) Steaming the chips in the chips bin/steaming vessel 11.

(b) Impregnating the chips with sulfur containing liquor within vessel 12 by circulating the chips within the vessel having the liquor, introduced at 26, therein.

(c) Subjecting the chips to cooking temperature and pressure conditions (e.g. a pressure of roughly about 8 to 10 bar and a temperature of roughly about 150° to 180° C.) while in a slurry of cooking liquor to effect digesting of the chips. The heated, impregnated chips are entrained in cooking liquor and move downwardly in a column (see arrows 31), in the absence of circulatory loops of treatment liquor, in the vessel 13.

(d) Effecting washing of the digested chips. This is preferably effected under pressure in the first pressure diffuser 14. Preferably there is only a small pressure reduction between the vessel 3 and the vessel 14.

Preferably the method also involves diluting the 10-20% consistency of the pulp at the bottom of the vessel 13 by adding black liquor (35, 36) to reduce the consistency to about 10% or less (e.g. about 6 to 10%). Also, the pulp is preferably subjected to hot alkali extraction in vessel 15 at a pressure only slightly reduced from that in the vessel 14, and then subjected to a second pressurized wash in pressure diffuser 16, for economy of heat and in order to maintain maximum pulp strength.

Practicing the method described above, it is possible to use poorer raw material than is used in most conventional pulp processing, yet to provide a more uniform Kappa distribution within the chips so that they can be cooked to lower Kappa numbers without losing strength.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of producing paper pulp from small chips of cellulosic fibrous material having a smallest dimension of between about 1 and 5 mm, and not in the form of sawdust comprising the steps of continuously and sequentially:

(a) steaming the chips:

(b) impregnating the chips with sulphur containing liquor under superatmospheric pressure by circulating the chips within and under the liquid level in a first vessel containing sulphur containing liquor to impregnate the chips;

(c) transferring the impregnated chips, under superatmospheric pressure, to a second pressurized vessel;

(d) subjecting the chips to cooking temperature and superatmospheric pressure which is above the pressure of the first vessel while in a slurry of cooking liquor to effect digestion of the chips in the second vessel, by moving heated, impregnated chips entrained in cooking liquor downwardly in a column, in the absence of circulatory loops of treatment liquors from the column; and (e) effecting washing of the digested chips.

2. A method as recited in claim 1 wherein steps (a)–(e) are practiced with chips having a smallest dimension of roughly 2 mm.

3. A method as recited in claim 1 wherein steps (a)–(e) are practiced with wood chips.

4. A method as recited in claim 1 wherein step (d) is practiced with the chips in a slurry having a consistency of about 10–20% solids.

5. A method as recited in claim 4 wherein step (d) is practiced at a pressure of roughly about 8–10 bar and a temperature of roughly about 150°–180° C.

6. A method as recited in claim 4 comprising the further step (f), between steps (d) and (e), of diluting the consistency of the chips slurry, if necessary, to about 10% or less.

7. A method as recited in claim 6 wherein step (f) is practiced with black liquor.

8. A method as recited in claim 6 wherein step (e) is practiced without substantial pressure reduction, and comprising the further steps, after step (d), of (g) controlling the flow of the washed chips, and then (h) subjecting the chips to hot alkali extraction at pressure conditions only slightly less than those in step (d).

9. A method as recited in claim 8 wherein step (g) is practiced by passing the slurry of chips through a flow control valve.

10. A method as recited in claim 8 comprising the further step (i) of effecting further pressurized washing of the chips after step (h) at roughly the same pressure conditions as in step (h).

11. A method as recited in claim 1 wherein step (b) is practiced with sulphur containing liquor having a first sulphur content, and wherein step (d) is practiced by adding cooking liquor to the chips after step (b), the cooking liquor having a second sulphur content, significantly less than the first sulphur content.

12. A method of producing paper pulp from small chips of cellulosic fibrous material not int eh form of sawdust, comprising the steps of continuously and sequentially:

(a) steaming the chips;

(b) impregnating the chips with sulphur containing liquor under superatmospheric pressure by circulating the chips within and under the liquid level in a first vessel containing sulphur containing liquor to impregnate the chips;

(c) heating the chips to digesting temperature;

(d) transferring the impregnated chips, under superatmospheric pressure, to a second pressurized vessel;

(e) digesting the chips in a slurry with sulphur containing liquor by passing the chips downwardly in a column at digesting temperature and pressure which is above the pressure of the first vessel in the presence of the sulphur containing liquor, in the absence of circulatory loops of treatment liquors from the column;

(f) effecting a first washing of the digested chips;

(g) without substantial pressure reduction, subjecting the washed chips to hot alkali extraction; and (h) without substantial pressure reduction, effecting a second washing of the chips.

13. A method as recited in claim 12 wherein step (e) is practiced with the chips in a slurry having a consistency of about 10–20% solids.

14. A method as recited in claim 13 wherein step (e) is practiced at a pressure of roughly about 8–10 bar and a temperature of roughly about 150°–180° C.

15. A method as recited in claim 13 comprising the further step (i), between steps (e) and (f), of diluting the consistency of the chips slurry, if necessary, to less than about 10%.

16. A method as recited in claim 15 wherein step (i) is practiced with black liquor withdrawn from step (f).

* * * * *